United States Patent [19]

Teague

[11] Patent Number: 4,922,815

[45] Date of Patent: May 8, 1990

[54] CONTAINER FOR COMPRESSED WASTE MATERIAL

[75] Inventor: Lyndon Teague, Wilmington, N.C.

[73] Assignee: Container Products Corp., Wilmington, N.C.

[21] Appl. No.: 290,709

[22] Filed: Dec. 27, 1988

[51] Int. Cl.[5] ..... B30B 15/10

[52] U.S. Cl. ..... 100/219; 100/227; 100/245; 220/1 T; 220/93

[58] Field of Search ..... 100/245, 256, 219; 220/1 T, 93; 206/442, 83.5

[56] References Cited

U.S. PATENT DOCUMENTS

| | | | |
|---|---|---|---|
| 257,454 | 5/1882 | Alexander | 100/219 |
| 1,126,325 | 1/1915 | Westenhiser | 100/219 |
| 1,852,195 | 4/1932 | Shaw | 100/219 |
| 2,526,987 | 10/1950 | Wilson | 100/219 |
| 3,826,186 | 7/1974 | Mechler | 100/219 |
| 4,905,521 | 6/1978 | Hauptman | 100/219 |
| 4,414,788 | 11/1983 | Berg | 206/83.5 |
| 4,426,927 | 1/1984 | Teague | 100/245 |
| 4,462,310 | 7/1984 | Jackson et al. | 100/219 |
| 4,748,908 | 6/1988 | Feezor et al. | 100/219 |
| 4,777,874 | 10/1988 | Manning | 100/219 |

FOREIGN PATENT DOCUMENTS

| | | | |
|---|---|---|---|
| 321250 | 5/1920 | Fed. Rep. of Germany | 100/219 |

*Primary Examiner*—Stephen Marcus
*Assistant Examiner*—Stephen Castellano

[57] ABSTRACT

A device for use in waste containers wherein the waste is packed, compressed and secured in its compact state within the container. The device comprises a rack consisting of a pair of telescoping cross bars with the opposite ends of said cross bars provided with yieldable anti spring back retainers that are adapted to be received and locked in guide channels carried by confronting interior wall surfaces of the waste container. These channels are complete with cooperating yieldable or pivotal anti spring back retainer clips positioned interiorly of the channels in the path of the respective ends of the rack's cross bars so as to secure the same in a latched depressed position against the compacted waste material within the container.

5 Claims, 8 Drawing Sheets

CONTAINER FOR COMPRESSED WASTE MATERIAL

SUMMARY OF THE INVENTION

In the normal process process of disposing of waste material, compactors are employed that normally compress and compact waste within a container until such container is fully loaded, at which time it is then sealed.

In commercial establishments the cost of disposing of waste is in direct proportion to its volume and it therefore becomes necessary to insure that the containers are as fully packed with compressed material as possible. It is the object of this invention to achieve this requirement.

In disposing of waste it is the normal practice that the waste be collected in a disposable bag usually composed from a vinyl or plastic material. This material has an inherent memory causing it, as well as the waste therein to return to its initial condition after it has been compressed. Thus, this inherent memory causes an unwanted expansion of the waste and its container creating a false fullness. It is the purpose of this invention to maintain such material in a compacted compressed state when placed within the disposable container until the maximum volume is obtained.

The anti spring back retainer racks of this invention consists of a frame constructed from a number of fixed or telescoping cross bars having, or adjustable to, the dimensions of the interior of the disposable waste container. Attached to the ends of these cross bars are retainer catches. Certain opposite interior wall surfaces of the container are provided with receiving guide channels that open toward the interior of the container and which slidably receive the ends of the retainers and their catches. There is provided internally of each channel member a set of horizontally aligned downwardly directed yieldable retaining clips. The downwardly projecting end of each of the retaining clips is backed by a neoprene backing member that will compress under pressure yet possess sufficient inherent memory causing it to return and retain its original shape and position as the retainer catches are forcibly moved thereover in one direction until the rack engages and restrains the waste in its compressed compact condition within the container.

Other objects of the invention will appear hereinafter.

BRIEF DESCRIPTION OF THE DRAWINGS

The invention will be best understood by reference to the accompanying drawings in which.

GENERAL DESCRIPTION

Figure 1:
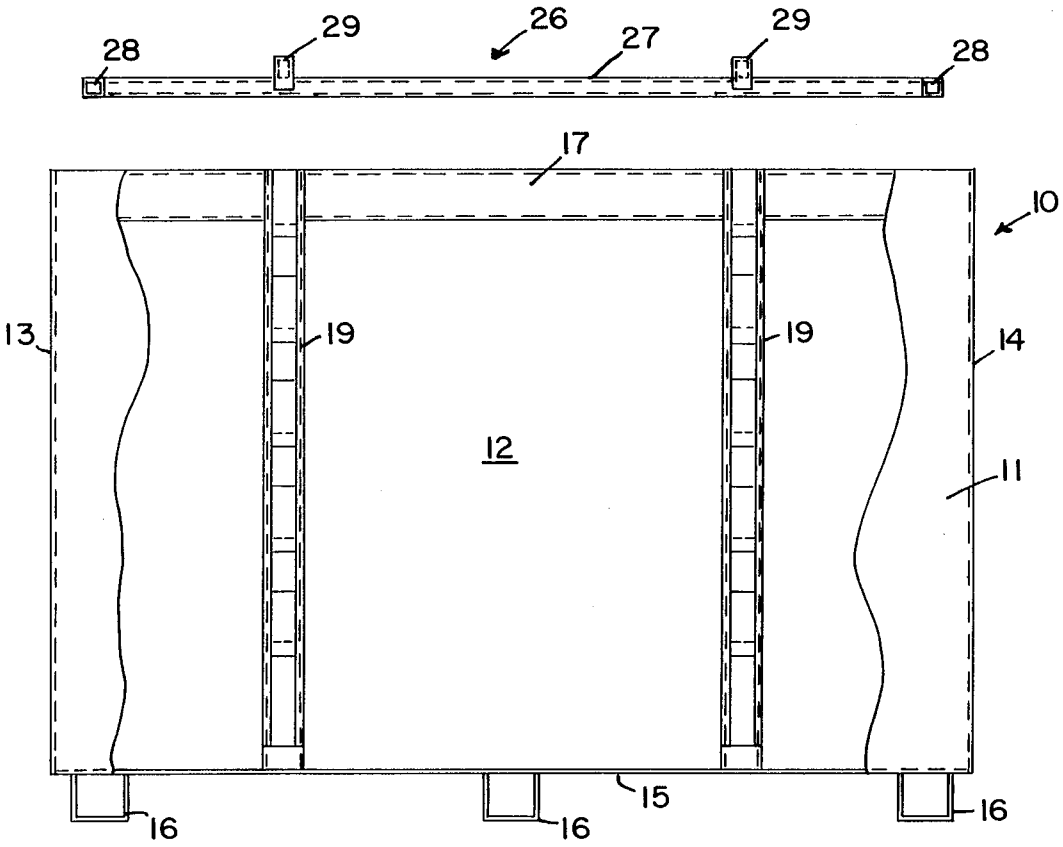
FIG. 1 is a fragmentary side elevational view of the waste container with the retainer rack in an elevated position.

A typical waste container is indicated by the numeral 10 in FIG. 1 and consists of a box-like structure having side walls 11 and 12, end walls 13 and 14 and bottom wall 15. The container is normally supported on a series of risers 16 which permit the handling of the container by a fork lift or the like.

Figure 2:
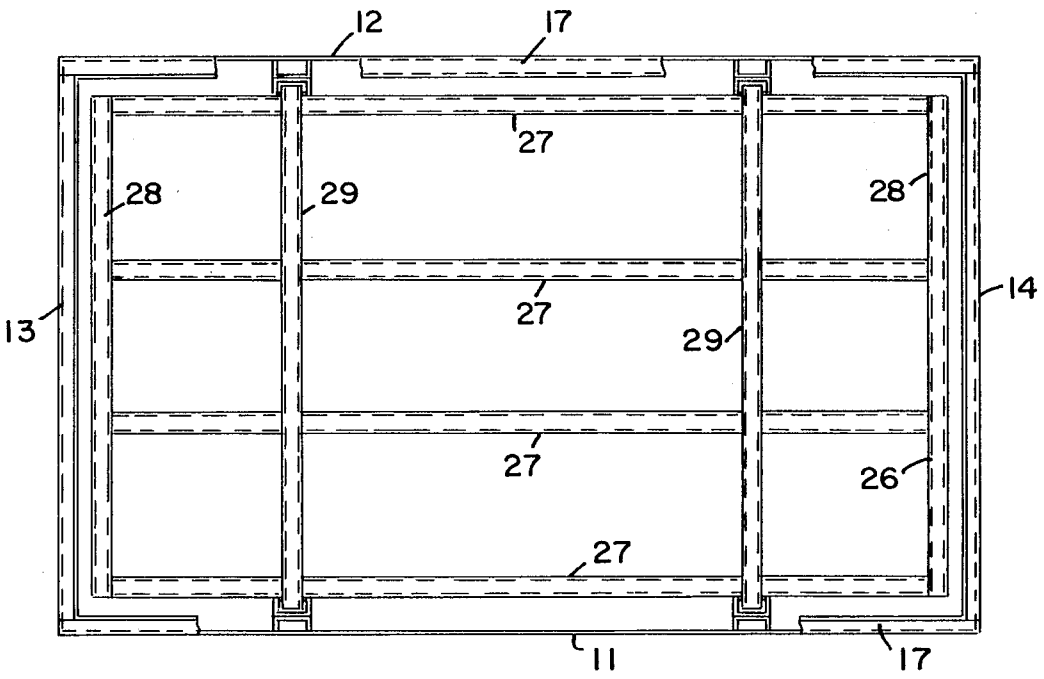
FIG. 2 is a top plan view of the waste container with the retainer rack positioned therein.

As illustrated in FIG. 2 the container 10 is provided with channel shaped reinforcements 17 which details the periphery of the open top of the container.

Also attached to the inner wall surfaces of the side walls 11 and 12 are a pair of spaced apart horizontally aligned channel shaped vertical reinforcements 18. Again as clearly illustrated in FIGS. 4 and 5, each of the vertical reinforcements 18 is provided with a reversely displaced guide channel 19 which opens to the interior of the container 10.

Figure 3:
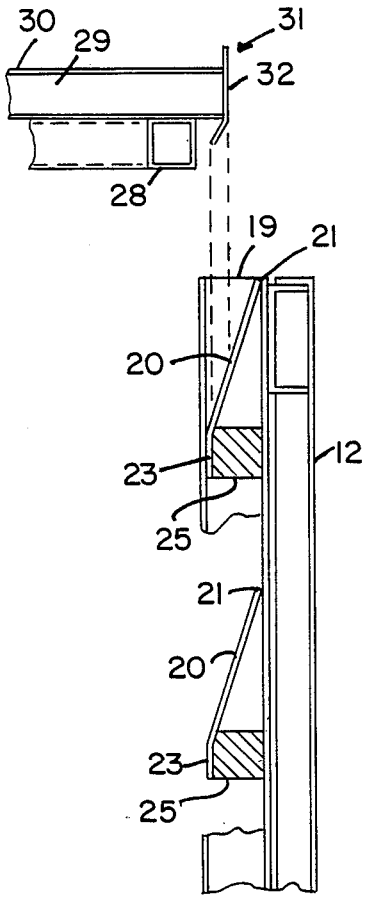
FIG. 3 is fragmentary side elevational view of the retainer clips and the retainer catches in spaced relationship.
Figure 4:
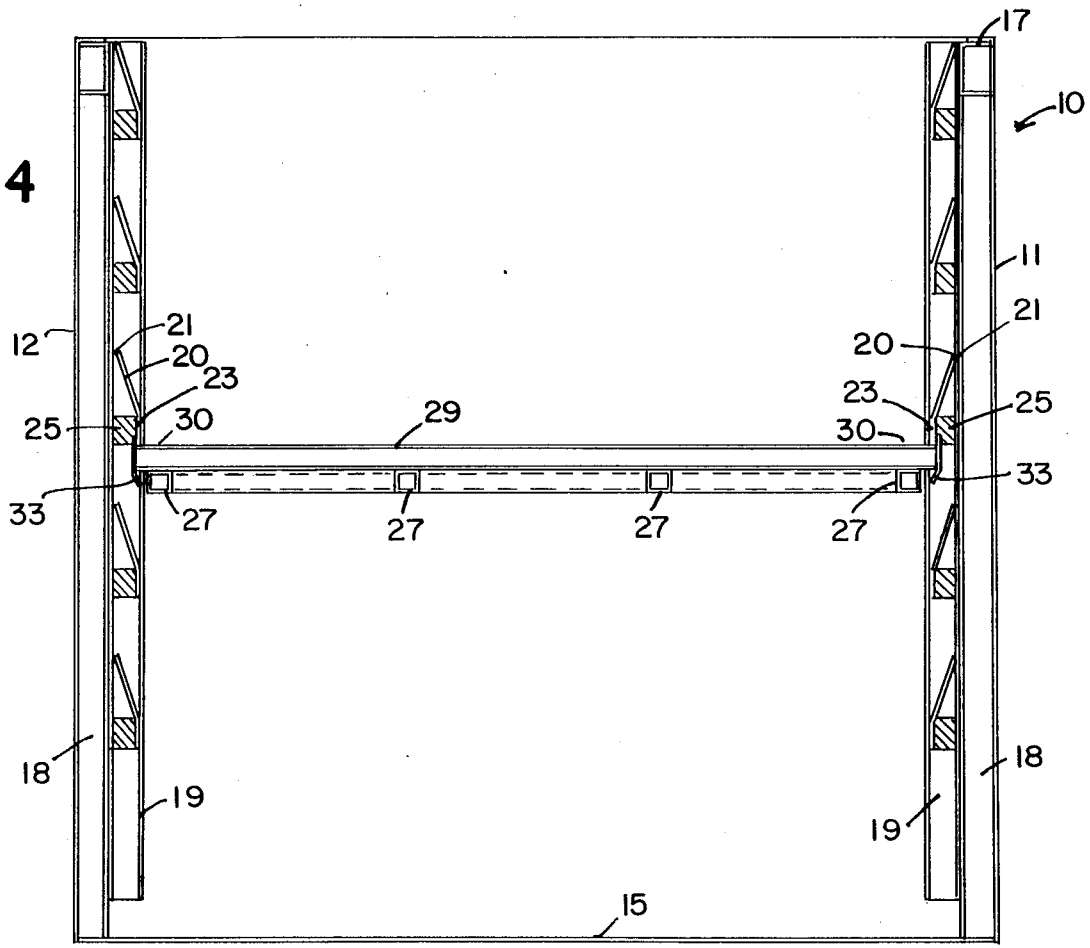
FIG. 4 is a side elevational detailed sectional view of the container with the retainer rack in a latched position.
Figure 5:
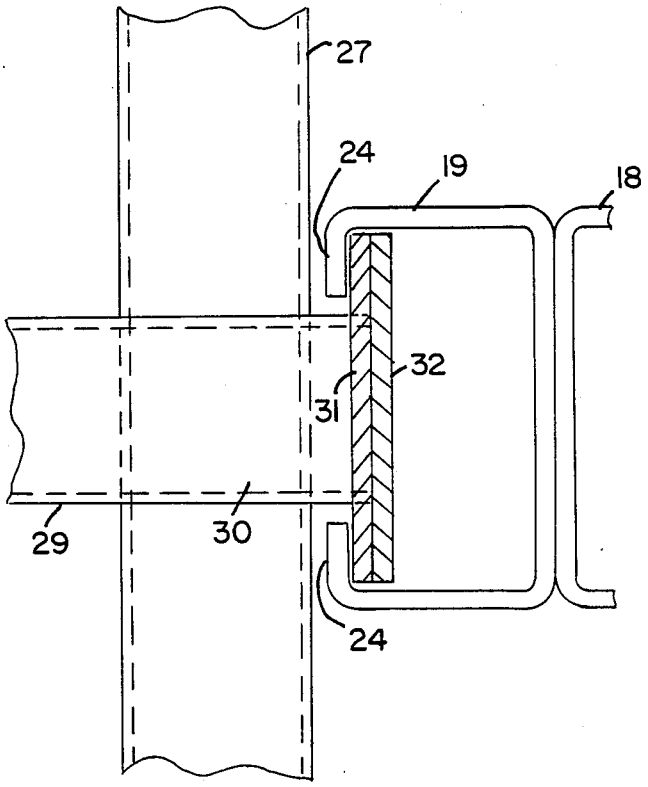
FIG. 5 is a detailed sectional view showing parts of the retainer rack and receiving means within the container.

Within the guide channel 19 and vertically spaced from each other while being horizontally aligned in each of the guide channels, are a series anti-spring back retainer clips 20. These clips 20 are constucted from a metallic material and have their uppermost end 21 fixedly attached within the guide channel 19. The clip is angled so as to transcend the full width of the guide channel 19 and has its free end 23 angled in a downward direction, as shown in FIGS. 3 and 4, so as to parallel, and be in contact with, the inwardly bent complimentary ends 24 of the side walls of the guide channel 19 as illustrated in FIG. 5. Each free end 23 of the clip 20 is backed by a neoprene rubber backing member 25. This backing member 25 assists in maintaining the free end 23 of the clip 20 in facial contact with the bent ends 24 of the guide channel 19.

To maintain the waste in a compacted condition within the container 10 there is provided a anti-spring back rack 26. As illustrated in FIG. 2 this rack 26 consists of a frame constructed from a series of elongated bars 27 joined at their opposite ends by connecting bars 28. A pair of cross bars 29 extend transversely across the elongated bars 27 and are of such a length so as to have their free end portions 30 projectable within the guide channels 19 carried by the side walls 11 and 12 of the container 10.

To either end of each of the cross bars 29 there is a anti-spring back catch 31. This catch includes a rectangularly shaped plate 32 which extends upwardly beyond the normal horizontal plane of its associated cross bar 29, as well as an angled cam face 33 which extends beneath the outwardly projected end 30 of the cross bar 29.

In use and as the waste is deposited into the container 10 the anti-spring back retainer rack 26 is placed within the open top of the container in a manner such that the end portions 30 of the cross bars 29 of the rack 26 are slidably positioned within the guide channels 19.

As the rack 26 is forced downwardly through the interior of the container 10, the angled cam faces 33 of the catches 31 will engage the free ends 23 of the anti-spring back clips 20 forcing them out of the path of the catches 31 against the normal expansion force of their respective rubber backings 25 until the rack 26 has engaged and compressed the waste within the container 10. In this position the raised portion of each of the catches 31 will engage behind the free ends 23 of the clips 20 and be secured.

It should also be noted that as illustrated in FIG. 5 the raised portion of the catch 31 is of a width equal to that of the clip 20 so as to lie behind the bend ends 24 of the side walls of the guide channel 19. By this construction the side walls of the container 10 are prevented from ballooning outwardly under the compressing force applied agaist the waste therein. Thus the anti-spring back rack 26 not only retains the waste in a compressed condition within the container 10 but maintains the shape of the container 10 so that it may be stored in an area comparable to its manufactured and designated size and volume capacity.

Figure 6:
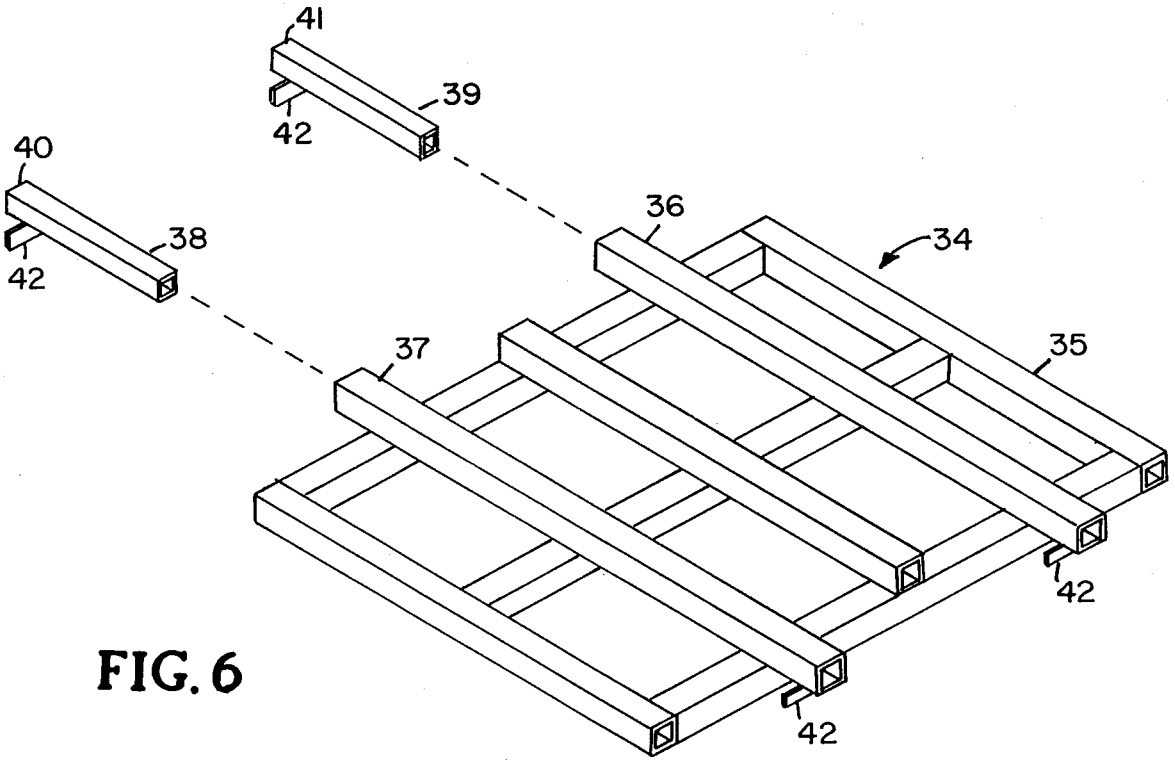
FIG. 6 is a perspective view of the modified telescopic retainer rack.

In FIG. 6 there is illustrated a modified anti-spring-back retainer rack 34, which consists of a rectangular frame constructed of tubular bars 35. Two of the cross bars 36 and 37 extend beyond opposite side edges of the rack 34 as shown and each telescopicaly receive extension bars 38 and 39 adapted to project out of one end of the cross bars 36 and 37. As shown the fixed end of the cross bars 36 and 37 as well as the free ends 40 and 41 of the extension bars 38 and 39 are each provided with depending clip engaging retainers 42.

Figure 8:
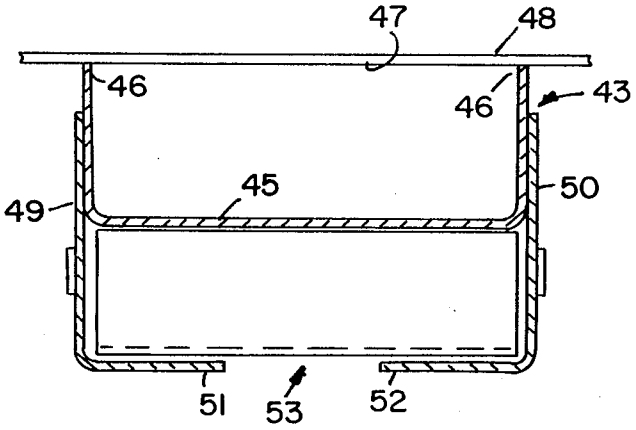
FIG. 8 is a fragmentary detailed sectional view of the modified retainer clip mounting assembly.
Figure 7:
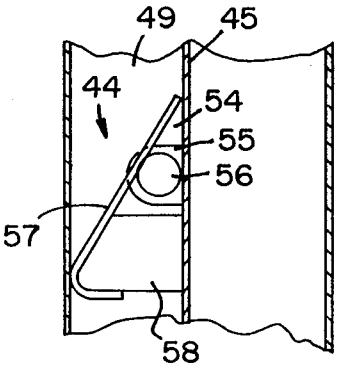
FIG. 7 is a fragmentary sectional view of a modified rack retaining clip.

A modified receiving channel 43 and retainer clip 44 are illustrated in FIGS. 7 through 10. The receiving channels 43 consists of a U-shaped support 45 adapted to have its free ends 46 attached to the inner wall 47 of the container 48 as seen in FIG. 8. Attached to the side walls of the U-shaped support 45 and extending laterally therefrom is a pair of L-shaped channel forming members 49 and 50. As shown in FIG. 8 when the L-shaped members 49 and 50 are attached to the support 45 the opposing ends 51 and 52 of the base of the L-shaped members 49 and 50 are in a spaced relation forming a passage 53 therebetween.

Figure 9:
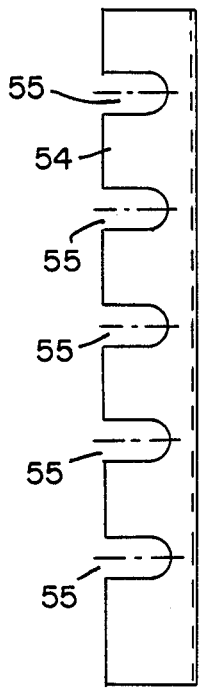
FIG. 9 is a side elevational view of one member of the rack receiving assembly.
Figure 10:
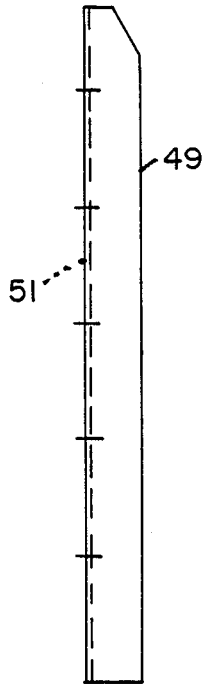
FIG. 10 is a side elevational view of another side of the rack retainer assembly.

As shown in FIG. 9 the leg portion 54 of each of the L-shaped members 49 and 50 are provided with a series of recesses 55, the base of which has a curved configuration. Adapted to be positioned in the recesses is a pivot pin 56 that has tangently connected thereto a pivotal retainer clip 57. Beneath the retainer clip 57 is a compressible backing 58 which functions in identical manner as to the heretofore described rubber backing 25.

As previously noted many present day waste containers become defective in their hold down position during the compacting of the waste in such containers. During compacting of waste the container sides bulge and consequently increase in width due to the compacting force induced on the waste material. This action caused the retainer to not fit properly in the rack and consequently not be in a locked in position.

By the use of the telescopical extension bars 38 and 39 this problem is overcome. And with the use of the pivotal retainer clip 57 the downward movement of the rack upon the compressed waste material may more easily pass beyond the pivotal clip until it reaches its desired locked position.

From the foregoing there has been described a waste container having a telescopic anti-spring back waste retaining rack which performs a multitude of functions, all of which are demanded by the waste disposal industry.

While there has been illustrated and described the preferred form of construction for carrying this invention into effect, this is capable of variation and modification without departing from the spirit of the invention. We, therefore, do not wish to be limited to the precise details of construction as set forth, but desire to avail ourselves of such variations and modifications as come within the scope of the appended claims.

Having thus described the invention what is claimed as new and desired to be protected by Letters Patent is:

1. An anti-spring back waste retainer for open top disposable waste container having a continuous bottom wall, a pair of side walls and a pair of end walls attached to the bottom wall and to each other at conforming corners thereof and comprising;

(a) a removable waste containing rack of a size to move through the open top of the waste container between the side walls and end walls thereof, (b) at least two pairs of vertically extending horizontally aligned guide means mounted on the side walls within the container, adapted to receive portions of said rack as it is moved through the container, (c) retaining clips provided throughout the longitudinal length of said guide means and movable out of an original position by said portions of said rack so as to permit said rack to move in one direction through said guide means, (d) catch members carried by said portions of said rack received in said guide means movable into contact with said clips for pivoting said clips from their original position out of the path of movement of said rack in said one direction, and with said catch member engageable with said clips after said clips have returned to their original position to prevent movement of said rack in an opposite direction and, (e) a backing member for said clips resisting movement of said clips from its original position by said catch member and for returning it to such position in the path of movement of said portions of said rack in said opposite direction.

2. A holddown rack for compressing waste deposited in a waste container comprising:

(a) a frame composed of a series of end and cross members, with said cross members of a length to provide free end portions, (b) extension members telescopically journalled in certain of said free end portions of said cross members for varying the size of the holddown rack, with said extension members providing free end portions, (c) guide means within the waste container for receiving the free end portions of said cross members and their extension members as the rack is moved vertically through the interior of the container against the waste deposited therein, and, (d) means for securing the free end portions of said cross members and their extension members in said guide means with the rack against the waste compressed within the container so as to maintain the waste in such compressed condition within the container.

3. A holddown rack as defined by claim 2 wherein said guide means consists of a series of U-shaped channels with the channels opening inwardly of the container and providing restricted openings through which the free end portions of said cross members and their extension members project when the rack is placed in the container.

4. A holddown rack as defined by claim 3 wherein said means for securing the free end portions of said cross members and their extension members in said guide means include yieldable clips carried by said guide means, with said clips extending into the path of movement of the free end portions of said cross members and their extension members so as to be yieldably moved thereby when the rack is moved in one direction through the container, and means for returning said clips to their original position after the free ends of said cross members and their extension members move beneath said clips so as to latch said rack in a waste compressing position within the container.

5. A holddown rack as defined by claim 4 wherein said clips are pivotally mounted within said guide means and yieldably held in the path of movement of the free end portions of said cross members and their extension members.

* * * * *